US012484717B1

(12) United States Patent
Kieres

(10) Patent No.: US 12,484,717 B1
(45) Date of Patent: Dec. 2, 2025

(54) WALL MOUNT BAND HOLDER SYSTEM AND METHOD

(71) Applicant: Chris Kieres, Venice, FL (US)

(72) Inventor: Chris Kieres, Venice, FL (US)

( * ) Notice: Subject to any disclaimer, the term of this patent is extended or adjusted under 35 U.S.C. 154(b) by 0 days.

(21) Appl. No.: 18/795,251

(22) Filed: Aug. 6, 2024

(51) Int. Cl.

| | |
|---|---|
| ***A47F 7/02*** | (2006.01) |
| *A45C 11/02* | (2006.01) |
| *A47F 5/08* | (2006.01) |
| *A47F 7/03* | (2006.01) |
| *A47F 7/06* | (2006.01) |
| *A47G 25/10* | (2006.01) |

(52) U.S. Cl.
CPC ..... *A47F 7/02* (2013.01); *A47F 7/022* (2013.01); *A45C 11/02* (2013.01); *A47F 5/08* (2013.01); *A47F 7/03* (2013.01); *A47F 7/06* (2013.01); *A47G 25/10* (2013.01)

(58) Field of Classification Search
CPC .... A47F 7/02; A47F 7/022; A47F 5/08; A47F 7/03; A47F 7/06; A47F 7/065; A47G 25/10; B60R 7/10; A45C 11/02
See application file for complete search history.

(56) References Cited

U.S. PATENT DOCUMENTS 1,912,297 A * 5/1933 Myers ..... E05C 17/04 217/60 C
2,136,843 A * 11/1938 Dinkel ..... A47B 67/005 312/285
2,689,060 A * 9/1954 Katzman ..... B65D 43/0222 40/724
5,176,263 A * 1/1993 Caruso ..... A47F 7/02 211/85.2
D354,970 S * 1/1995 Bolle ..... D16/312
5,425,971 A * 6/1995 Chiang-Cheng ..... A45D 40/22 206/823
5,427,123 A * 6/1995 Odenthal ..... A45D 8/36 132/275
D360,787 S * 8/1995 Brown, Sr. ..... D6/512
5,791,473 A * 8/1998 Decker ..... G03C 3/00 220/366.1
6,237,843 B1 * 5/2001 Falat ..... B65D 51/245 206/459.5
D456,176 S * 4/2002 Dashefsky ..... D28/73
6,672,463 B2 * 1/2004 Dashefsky ..... A45D 8/002 211/163
7,311,416 B1 * 12/2007 Kudma ..... A45D 33/22 206/823

(Continued)

*Primary Examiner* — Devin K Barnett

(57) ABSTRACT

A system is provided for displaying ornamental headbands when not in use. The system comprises a headband directed to vertical positioning on a user's head. The system also comprises a first round disc with dimensions about five inches in diameter and about two inches in thickness, a circumference of the disc positioned within a circumference of the headband and supporting the headband as at least one of a free-standing headband holder and a wall-mounted headband holder. A second round disc of similar diameter as the first disc and about one eighth inch thickness is positioned on a front surface of the first disc, and the second disc displaying images on both sides. A third round disc of similar diameter and thickness of about one eighth inch is attached to a rear surface of the first round disc hooking mechanism machined into the backward facing surface of the third disc.

6 Claims, 3 Drawing Sheets

(56) References Cited

U.S. PATENT DOCUMENTS 7,740,370 B2 * 6/2010 Campbell ..... A45D 33/26 362/135
D699,568 S * 2/2014 Epstein ..... D9/425
9,420,860 B2 * 8/2016 Jaffe ..... A47F 5/02
D795,837 S * 8/2017 Cai ..... D14/205
9,833,051 B2 * 12/2017 Chinlund ..... A45C 13/02
10,425,715 B2 * 9/2019 Green ..... H02J 7/00
10,772,714 B1 * 9/2020 Chapman ..... A61C 19/02
D899,771 S * 10/2020 Chinlund ..... D3/294
D1,002,363 S * 10/2023 Lee ..... D9/425
11,871,859 B1 * 1/2024 Morrison ..... A47F 5/08
D1,060,948 S * 2/2025 Galle ..... D2/871
2001/0016958 A1 * 8/2001 Linday ..... A42B 1/0187 2/200.1
2002/0162765 A1 * 11/2002 Okin ..... B65D 43/162 221/48
2004/0164034 A1 * 8/2004 Costanza ..... A45D 8/002 211/13.1
2005/0045520 A1 * 3/2005 Johnson ..... A45C 11/20 206/545
2006/0032782 A1 * 2/2006 Suh ..... A45C 13/02 206/581
2006/0091036 A1 * 5/2006 Casella ..... B65D 77/0453 206/459.5
2006/0185991 A1 * 8/2006 Abercia ..... B42D 15/027 206/232
2006/0289321 A1 * 12/2006 Karfias ..... A45C 11/16 211/85.2
2007/0029328 A1 * 2/2007 Polisano ..... B65F 1/1623 220/495.08
2010/0096350 A1 * 4/2010 Ma ..... A47F 5/08 211/133.6
2011/0094015 A1 * 4/2011 Braun ..... A42B 1/248 2/209.13
2012/0000812 A1 * 1/2012 Gunter ..... A45D 8/002 206/525
2012/0138642 A1 * 6/2012 Jensen ..... A47G 25/746 223/85
2013/0075295 A1 * 3/2013 Sina ..... B65D 43/0208 206/459.5
2013/0270133 A1 * 10/2013 Kenner ..... B65D 5/4266 206/320
2014/0263116 A1 * 9/2014 Wojciechowski .... A47F 5/0807 211/85.2
2017/0258193 A1 * 9/2017 Leo ..... A45D 8/16
2018/0344058 A1 * 12/2018 Petner ..... A47G 25/10
2019/0222916 A1 * 7/2019 Kim ..... H04R 1/1025

* cited by examiner

200

WALL MOUNT BAND HOLDER SYSTEM AND METHOD

CROSS REFERENCE TO RELATED APPLICATIONS

None

FIELD OF THE DISCLOSURE

The present disclosure is in the field of amusements and toys. More particularly the present disclosure describes systems and methods of providing a device for placement in a decorative headband when not worn that displays images of a user's choice and may be attached to a wall surface for viewing and enjoyment.

BACKGROUND

Visitors to amusement parks and attendees of concerts and other events often acquire decorative headbands with fabric ears or other attachments to commemorate their experience. After such attendance, such headbands often fall into disuse as the event has passed. The user may wish to retain possession of the headband as a memento, but headbands may prove difficult to display neatly or conveniently in a room or on furniture. In many instances, a commemorative headband ends up being discarded or placed in a drawer or box, soon to be forgotten.

Figure 1:
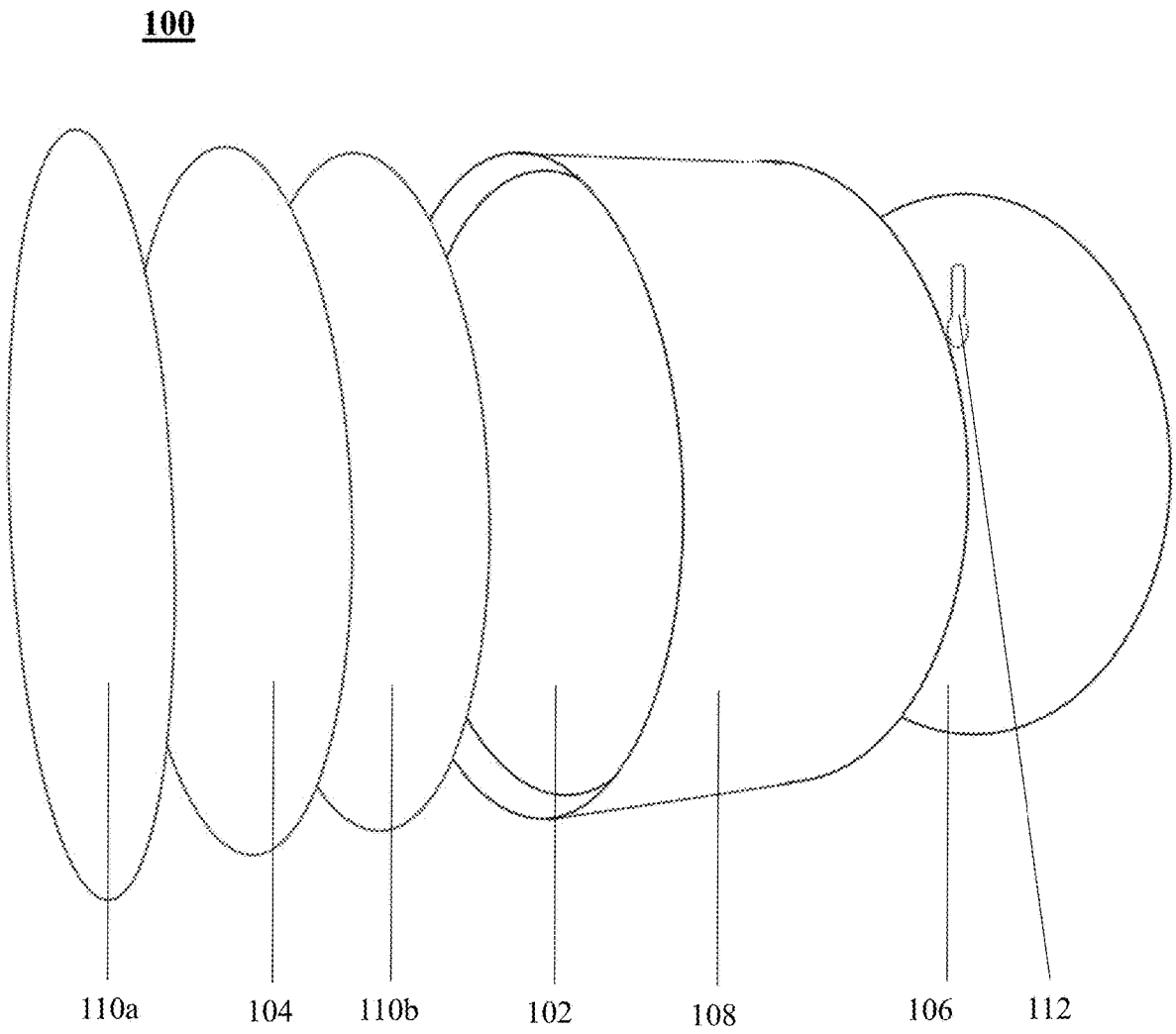
FIG. 1 is a drawing of a wall mount band holder according to an embodiment of the present disclosure.

Systems and methods provide a wall mount band holder device configured to display popular images, the device directed to placement within a decorative headband and enabling vertical hanging of the headband and the held device on a wall surface or displayed in a freestanding manner on a horizontal surface. The device allows images to be displayed in a decorative manner accompanied by the headband when not in use by a user.

The headband may be of the type used for ornamental and recreational purposes that may be purchased at an amusement park, for example. The headband is worn vertically over the top of the user's head and extending downward in front of the user's ears. The headband in many cases may have fabric ears, antlers, bows, or other ornamentation attached to an upper surface.

The elastic resistance of the headband and tendency to return to a resting position causes the headband to gently and comfortably grip the user's head and not fall off with normal use. It is this elastic property that, when the headband is not being worn, holds the device circumferentially in place around the band holder device and allows the combined headband and device to be hung vertically on a wall for viewing.

Many headbands of this type fall into disuse shortly after purchase and are tossed aside in drawers and out of sight. They are often forgotten even though they are attractive souvenirs and bring back good memories of an amusement park visit, concert, or another event where the headband was acquired.

The disc device provided herein is held within the headband, features an image of the user's choice on the front, and has a hooking mechanism on its rear-facing surface that allows the headband to be hung on a wall or other vertical surface. The disc device allows the user to display and enjoy the headband long after the user initially acquires the headband.

The device comprises three discs of about five inches in diameter. A first disc, referred to herein as a solid inner core unit, is about two inches in height and is surrounded by a collar-like or belt-like outer foam wrap around the circumference of the first disc. The wrap is slightly wider than the approximate two-inch height of the core unit. The edge of the wrap is lip-like and allows a second disc, referred to herein as a first solid disc layer, to be held by the foam wrap against the front-facing surface of the solid inner core unit.

The second disc is of a thickness of about one eighth inch and may be manually placed into the lip-like structure of the foam wrap and may also be manually removed therefrom in a similar manner. The lip-like structure effectively creates a shallow front cup that is designed as a friction fit such that the second disc or first solid disc layer fits snugly into the shallow cup, but can also be easily removed, reversed, or replaced with a different compatible second disc.

The second disc may have images on each side that the user may choose to display outward that are prominently visible when the device and headband mounted on the device are hung on a wall surface or displayed in a freestanding manner. The images on either side may be of the user or another person or may depict characters or other artwork well known in pop culture.

On the other side, or backside, of the first disc is a third disc that is glued or otherwise permanently attached thereto. In embodiments, the third disc may be referred to as a second solid disc layer. The third disc holds a hooking mechanism that allows the combined headband and device to be hung on a wall surface.

The third disc, like the second disc, is also of a thickness about one eighth inch. The third disc features a keyhole cutout which is a machined feature used to provide a mechanism to hang the entire assembly of device and headband on a wall with an appropriately sized holding screw.

The first and second disc, which are held together by the outer wrap, and the third disc which is permanently bound to the backside of the first disc, are as a group held by the headband via the headband gripping the outer wrap with its elastic property. The system may then be hung on a wall surface via the hooking mechanism with the second disc facing outward and the displayed image on the surface of the second disc appearing prominently in the headband where the user's face would normally be.

In an embodiment, a user, for example a school-aged girl, may acquire numerous headbands during visits to amusement parks and events. The headbands may have sentimental value, and the user may wish to display the headbands in a collage or otherwise arranged manner on a wall or shelf of a bedroom, for example.

The system provided herein promotes the user to display an image of choice in the area of the headband where the user's face would normally be when the headband is worn. Images displayed on the second and outward facing disc could be of popular fictional characters associated with an amusement park operator, or of faces of persons popular with that age group, for example "boy band" musicians or vocalists.

In an embodiment, the amusement park operator may be in possession of trademarked fictional characters that appear at the amusement parks and/or in cinematic material produced by the operator. The operator may sell numerous versions of the first solid disc layer that can be interchangeably placed by the user into the headband. Similarly, a sports team could sell numerous versions of the first solid disc layer featuring team logos or popular players on the team.

Turning to the figures, FIG. 1 is a diagram of a wall mount band holder according to an embodiment of the present disclosure. FIG. 1 depicts components and interactions of a system 100 of the holder. The system 100 comprises a solid inner core unit 102, a first solid disc layer 104, a second solid disk layer 106, and an outer foam wrap 108. For brevity, these components may be referred to herein after respectively as the core unit 102, the first disc layer 104, the second disc layer 106, and the wrap 108.

Also provided by system 100 is the art canvas layer 110*a-b* which are the images attached to the front and back of the first disc layer 104 which may be interchangeably moved to the front or outer facing surface and thereby displayed. A user would be able to manually remove the first disc layer 104 from the cup-like enclosure provided by the outer foam wrap 108.

If the art canvas layer 110*a* had been previously facing outward and therefore visible, the user could remove and turn or flip over the first disc layer 104 such that the art canvas layer 110*b* is now facing outward and the art canvas layer 110*a* is now facing inward and no longer visible. System 100 also comprises a keyhole cutout 112 machined into the second disc layer 106 for placement of a hooking mechanism allowing hanging of the system on a wall surface.

Figure 2:
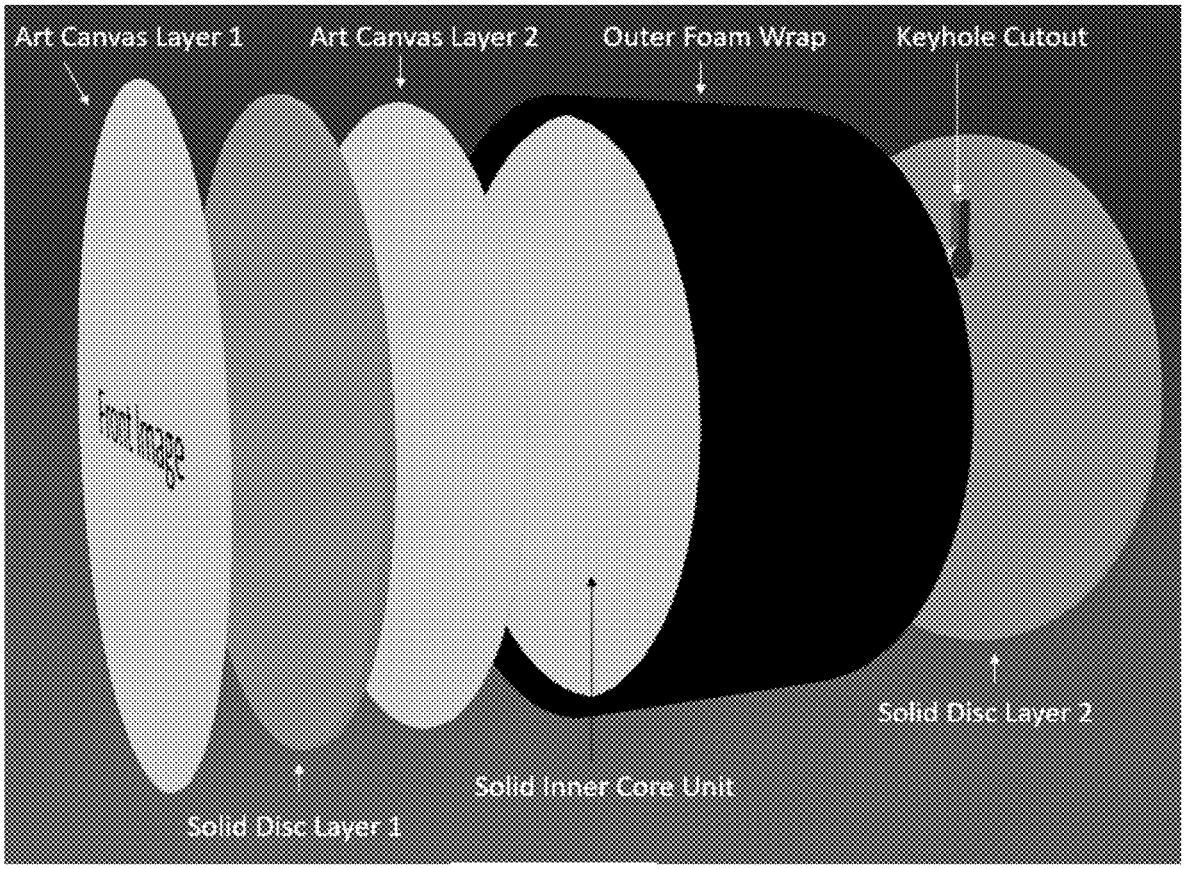
FIG. 2 is a drawing of a wall mount band holder according to an embodiment of the present disclosure.

FIG. 2 provides the same image as FIG. 1 but without component numbering and instead with component naming. In FIG. 2, what are enumerated in FIG. 1 and the system 100 as the first solid disc layer 104 and the second solid disk layer 106 are displayed in FIG. 2 as a solid disc layer 1 and a solid disc layer 2, respectively. Similarly, what are enumerated in FIG. 1 and the system 100 as art canvas layer 110*a-b* are displayed in FIG. 2 as art canvas layer 1 and art canvas layer 2, respectively.

Figure 3:
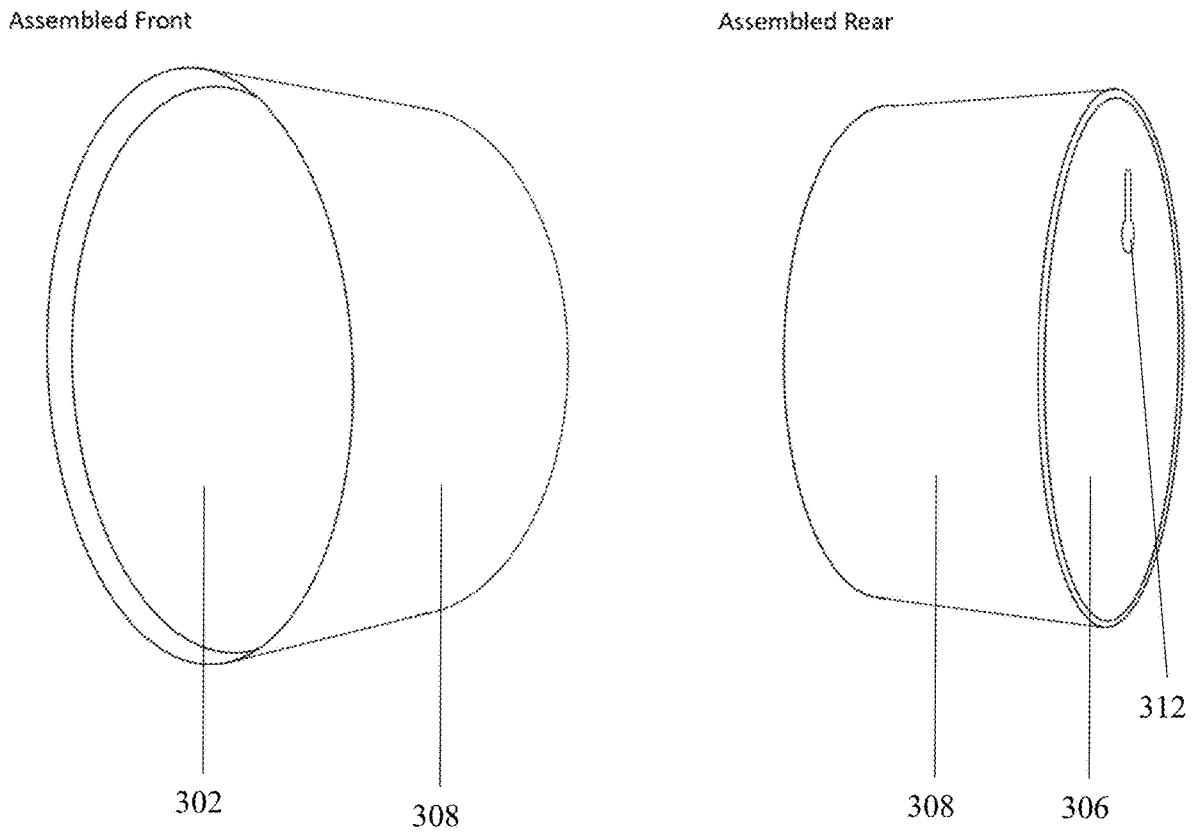
FIG. 3 is a drawing of a wall mount band holder according to an embodiment of the present disclosure.

FIG. 3 is a view of the assembled front and the assembled rear of the system. FIG. 3 depicts a system 300 with components indexed to the components of the system 100 and depicted in FIG. 1 and FIG. 2.

The lefthand image in FIG. 3 illustrates the assembled front of the system 300 with the solid inner core unit 302 and the outer foam wrap 308 displayed. The first solid disc layer 104 or second disc which would normally be in place in the front of the solid inner core unit 302 and held in place by the foam wrap 308, is not shown in FIG. 3. It bears pointing out here that as an assembled unit with all components included and shown, this front view would show the image (art canvas layer 1 or art canvas layer 2 shown in FIG. 2) depicted on the front or outward facing side of the first solid disc layer 104. Disc 104 would be shown, and the inner core 302 would not be visible.

The righthand image in FIG. 3 illustrates the backside or rear facing portion of the system 300. The second solid disc layer 306 is shown as is the wrap 308. Also shown is the keyhole cutout 312, the machined feature used to provide a mechanism to hang the entire assembly on a wall with an appropriately sized holding screw.

While not shown in any of the figures provided herein, the headband as described above may be an integral component of systems and methods provided herein. The assembled unit does not require a headband to hold it together. The three disc components are held together by the foam wrap 108 and by the permanent attachment of the second solid disc layer 106, i.e. the backside, via gluing to the solid inner core unit 102. The solid inner core unit 102 is held in place by virtue of the elastic resistance of the foam wrap 108. If the first disc layer 104 is removed, the rest of the unit is unaffected aside from showing the core material.

While embodiments described herein have been directed to discs which are by definition round, in other embodiments the components provided herein as discs may not be round and may instead be shaped in other manners. They may, for example, be oval-shaped or square or rectangular.

Most embodiments described herein have involved the three discs placed within a headband such that elastic force of the headband grips the outer foam wrap component surrounding and holding the three discs such that the combined headband and discs can be hung on a wall surface via a hooking mechanism on a rearward facing surface of the third disc. In embodiments, the outer foam wrap component and the three discs held by the wrap need not be held by a headband to be functional and to be of value. The headband is not a mandatory component of all systems taught or suggested herein. The wrap, the discs, and images displayed by the second disc may be suspended on a wall surface for display, may be hung on a holiday tree, for example, or may be placed on a flat surface such as a table. The wrap, the discs, and images may be deployed and presented in an entirely freestanding manner without any involvement of a headband.

In an embodiment, a system is provided for displaying ornamental headbands when not in use. The system comprises a headband directed to vertical positioning on a user's head. The system also comprises a first round disc with dimensions about five inches in diameter and about two inches in thickness, a circumference of the disc positioned within a circumference of the headband and supporting the headband as at least one of a free-standing headband holder and a wall-mounted headband holder. The system also comprises a second round disc of similar diameter as the first disc and about one eighth inch thickness, the second disc positioned on a front surface of the first disc, and the second disc displaying images on both sides. The system also comprises a third round disc of similar diameter and thickness of about one eighth inch attached to a rear surface of the first round disc hooking mechanism machined into the backward facing surface of the third disc.

The headband may have decorative ears, antlers, or other decorative fabric protrusions attached to an upward facing edge of the headband. An outer foam wrap component surrounds the circumference of the first disc in a collar-like manner.

The outer foam wrap component is of width exceeding two inches enabling attachment of the second disc to the first disc, the width exceeding two inches providing a cup with a friction fit for placement of the second disc. The integrated hooking mechanism enables vertical attachment of the system to a wall surface.

The vertical attachment promotes the displayed image to face outward and be viewable. The discs are positioned in the headband at an area of the user's head when the headband is worn.

The discs replace the user's head when the user elects not to wear the headband. The system promotes interchangeability of sides of the second disc and wherein a user chooses an image on a first side of the second disc or an image on a second side of the second disc, the images attached to the second disc for entertainment purposes.

In another embodiment, a system is provided for adding ornamentation to a headband when not in use. The system comprises a decorative ornamental headband for wearing in a vertical manner on a user's head. The system also comprises three discs of approximate diameter five inches each stacked atop one another, a first disc held in place by elastic resistance of an outer foam wrap component surrounding a circumference of the first disc of the three discs. The system also comprises images of the user's choice on a flexible material attached to opposite sides of a second disc of the three discs comprising an outermost of the three discs, the second disc attached to a front side of the first disc, the second disc held in place by the elastic resistance generated by the outer foam wrap component as it uniformly contacts the full outer perimeter of the second disc. The system also comprises a third disc of the three discs comprising an innermost of the three discs, the third disc attached to a backside of the first disc with its perimeter also covered by the outer foam wrap component.

The three discs comprise the first disc of thickness about two inches and the second disc and third disc of thickness about one eighth inch each, the second disc placed within and held circumferentially by a front-facing cup created by the outer foam wrap component. The outer foam wrap component surrounds the circumference of the first disc in a collar-like manner.

The outer foam wrap component is of width exceeding two inches enabling attachment of the second disc to the first disc, the width exceeding two inches providing a cup with friction fit for placement of the second disc. The discs display images without a need for the headband.

A hooking mechanism integrated within the third disc enables vertical attachment of the system to a vertical surface. The image as held by the second disc faces outward toward viewers when the system is attached to a vertical surface.

In yet another embodiment, a method is provided for adding ornamentation to a decorative headband when not worn. The method comprises a first disc of approximate diameter five inches receiving circumferential placement within a circumference of a headband not presently worn. The method also comprises the first disc receiving placement of a second disc of same width over an outward facing surface of the first disc, the second disc bearing an image facing outward and visible to viewers of the headband. The method also comprises the headband, discs and image receiving attachment to a wall surface for display purposes.

The method also comprises the first disc receiving attachment on a backward facing surface of a third disc, the third disc having an integrated hooking mechanism incorporated into a rearward facing surface.

The method also comprises the first disc receiving envelopment by an outer foam wrap component in a collar-like manner around a circumference of the first disc, the component configured with lip edges to hold the second disc and the third disc on opposite surfaces of the first disc.

The method also comprises the second disc hosting images of a user's choice on each side of the second disc, the images manually interchangeable at a choice of a user.

The invention claimed is:

1. A system for displaying ornamental headbands when not in use, comprising:

a headband configured to be vertical positioned on a user's head;

a first round disc with dimensions about five inches in diameter and about two inches in thickness, a circumference of the first disc is positioned within a circumference of the headband to support the headband as at least one of a freestanding headband holder and a wall-mounted headband holder;

a second round disc of similar diameter as the first disc and about a one eighth inch thickness, the second disc positioned on a front surface of the first disc, and the second disc comprises images on a front side of the second disc and a rear side of the second disc; and a third round disc of similar diameter as the second disc and having a thickness of about one eighth inch attached to a rear surface of the first round disc and a hooking mechanism defined in a backward facing surface of the third disc wherein an outer foam wrap component surrounds the circumference of the first disc in a collar-like manner;

wherein the outer foam wrap component has a width that is greater than two inches to enable attachment of the second disc to the first disc, and wherein the width of the outer foam wrap component defines a cup with a friction fit for placement of the second disc.

2. The system of claim 1, wherein the headband has decorative ears attached to an upward facing edge of the headband.

3. The system of claim 1, wherein the hooking mechanism is configured to enable vertical attachment of the system to a wall surface.

4. The system of claim 3, wherein the vertical attachment is configured to promote at least one of the images to face outward and be viewable.

5. The system of claim 1, wherein the discs are configured to be positioned in the headband at an area of the user's head when the headband is worn.

6. The system of claim 1, wherein the front side and the rear side of the second disc are interchangeable and wherein a user is configured to choose the image on a front side of the second disc or the image on the rear side of the second disc to be displayed, the images are attached to the second disc for entertainment purposes.

* * * * *